United States Patent [19]

Kato

[11] Patent Number: 4,655,239

[45] Date of Patent: Apr. 7, 1987

[54] WATER-PRESSURE-OPERATED GAS VALVE FOR INSTANTANEOUS GAS WATER HEATER

[75] Inventor: Takeshi Kato, Aichi, Japan

[73] Assignee: Rinnai Corporation, Aichi, Japan

[21] Appl. No.: 866,627

[22] Filed: May 23, 1986

[30] Foreign Application Priority Data

Jun. 19, 1985 [JP] Japan ..... 60-91534[U]

[51] Int. Cl.[4] ..... F23N 1/08

[52] U.S. Cl. ..... 137/94; 137/630.15; 251/75

[58] Field of Search ..... 137/94, 630.15; 251/75

[56] References Cited

U.S. PATENT DOCUMENTS 2,073,168 3/1937 Newell ..... 137/630.15

2,608,352 8/1952 Schuster et al. ..... 251/75

2,690,857 10/1954 Jenkins ..... 137/630.15 X 2,831,504 4/1958 Coffey ..... 137/630.15

FOREIGN PATENT DOCUMENTS 27111 8/1971 Japan ..... 137/94

*Primary Examiner*—Martin P. Schwadron

*Assistant Examiner*—Stephen M. Hepperle

*Attorney, Agent, or Firm*—Nilsson, Robbins, Dalgarn, Berliner, Carson & Wurst

[57] ABSTRACT

A water-pressure-operated (i.e., faucet-controlled) gas valve of an instantaneous water heater which opens and closes a gas passage to a main burner in accordance with the pressure of supplied water, resulting from the use of adjusting screws in first and secondary valves cooperating with a constant force spring.

1 Claim, 4 Drawing Figures

WATER-PRESSURE-OPERATED GAS VALVE FOR INSTANTANEOUS GAS WATER HEATER

PRIORITY CLAIM

This application claims priority under 35 USC 119 from Japanese patent application Ser. No. 60-91534, filed June 19, 1985.

FIELD OF THE INVENTION

The field of art to which the invention pertains is the field of instantaneous gas water heaters.

BACKGROUND AND SUMMARY OF THE INVENTION

In the Official Gazette on Japanese Utility Model Publication No. 8264/1985, there is disclosed a water-pressure-operated gas valve of a faucet-controlled gas water heater in which primary and secondary valves are provided that open and close a gas passage of a main burner sequentially through the intermediary of a valve rod moving in accordance with the quantity of supplied water. The primary valve is devised so that conduit orifices on the top side of the secondary valve are opened and closed in a snapping manner by the movement of said valve rod through the intermediary of a disk-shaped leaf spring.

The secondary valve of the aforesaid water-pressure-operated gas valve, however, is an on-off valve which opens and closes in accordance with the water flow rate and thus it is not capable of adjusting the gas input, that is, the amount of combustion, in accordance with the water flow rate.

The present invention eliminates this disadvantage by constructing the secondary valve as a modulation valve whose opening is adjusted in accordance with the water flow rate; the correlative position of the secondary valve to an element operating in accordance with the quantity of supplied water is essential. When priority is given to this point in assembling, however, a number of components need to be interposed between said element and the secondary valve, and consequently an error tends to occur in the correlative position of the secondary valve to said element due to the integration error or assembly error of these components. When the aforesaid error is corrected, on the other hand, another error is caused in the positional relationships between the valve rod and a snap spring and between said snap spring and the primary valve.

In view of the existing state of the prior art, the present device is designed to attain a gas valve whose assembly is taken into consideration, and it is constructed in such a manner that the gas valve is reliably able to open and close the gas passage in accordance with the pressure of the supplied water. More particularly, a water-pressure-operated gas valve is provided with a primary valve and a secondary valve which open and close a gas passage of a main burner sequentially through the intermediary of a valve rod moving in accordance with the flow rate of supplied water. The primary valve is devised so that conduit orifices provided on the top side of the secondary valve, for conducting the minimum quantity of gas, are opened and closed in a snapping manner by the movement of a valve rod through the intermediary of a disk-shaped constant force spring. The secondary valve is constructed as a modulation valve whose opening is varied in accordance with the amount of movement of the valve rod, while a first adjusting screw is threaded in the top portion of the secondary valve so that it supports the constant force spring. The upper end of the valve rod, piercing through the secondary valve, is made to face the lower surface of the constant force spring, while a second adjusting screw threaded in the primary valve is provided so that the lower end thereof faces the constant force region of the constant force spring on the top surface thereof.

DETAILED DESCRIPTION

Figure 1:
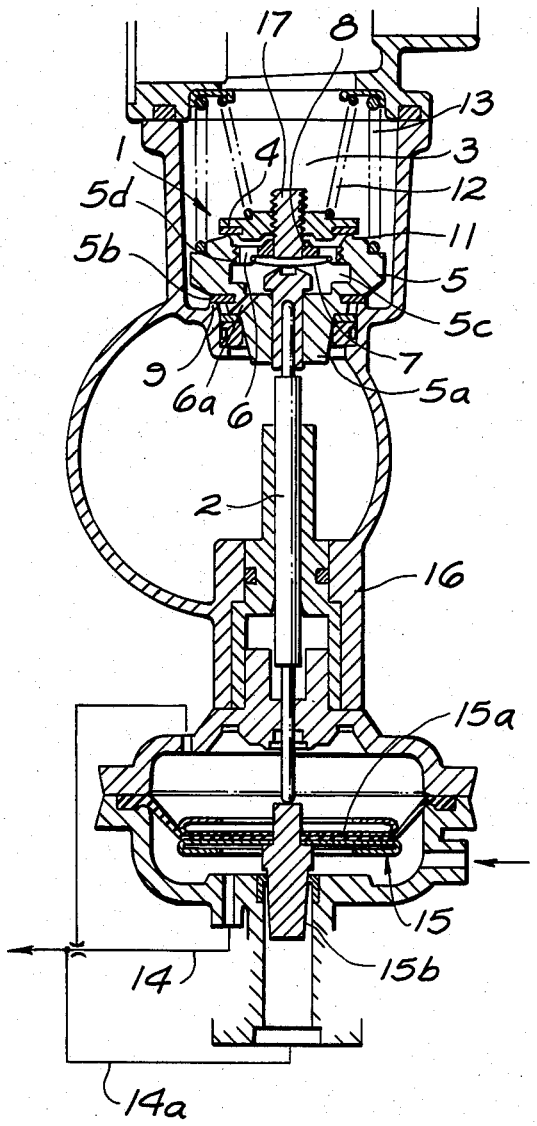
FIG. 1 is a sectional side view of one embodiment of the present invention.

One embodiment of the present invention will be described in the reference to the drawings. In the drawings, numeral 1 denotes a water-pressure-operated automatic gas valve provided with a primary valve 4 and a secondary valve 5 which opens and closes a gas passage 3 of a main burner sequentially through the intermediary of a valve rod moving in accordance with the flow rate of supplied water. The primary valve 4 is provided so that conduit orifices 6 provided on the top side of the secondary valve 5, for conducting the minumum quantity of gas, are opened and closed in a snapping manner through the intermediary of a diskshaped constant force spring 7.

The construction described above is not different specifically from the prior-art water-pressure-operated automatic gas valve described previously. The constant force spring 7 is a spring having a region in which a force is not varied for displacement.

In accordance with the present invention, the primary valve 5 is constructed as a proportional, i.e., modulation valve whose opening is varied in accordance with the amount of movement of the valve rod 2. A first adjusting screw 8 is threaded in the top portion of said secondary valve 5 so that it supports the constant force spring 7. The upper end of the valve rod 2 piercing through the secondary valve 5 is made to face the lower surface of said constant force spring 7, while the lower end of a second adjusting screw 17, threaded in the primary valve 4, is opposed to the upper surface of said constant force spring 7 a gap apart, a space equivalent to the distance of movement of the constant force spring 7 to a neutral position.

In more detail, the secondary valve 5 is formed to be a modulation valve by providing a tapered portion **5*a* in the outer periphery of the lower part thereof, while a setting sheet 5*b* is provided in the upper part of the tapered portion 5*a* and is seated on a valve seat 9 provided in the gas passage. A concavity 5*c* is defined in the upper part of the secondary valve 5, while an internal female thread 5*d*, in which the cover-shaped first adjusting screw 8 is threaded, is formed on the inner peripheral surface of the secondary valve 5 defining the concavity 5*c*. The first adjusting screw 8 is formed in the shape of a cylinder with a top plate, and the aforesaid disk-shaped constant force spring 7 is inserted thereinto from the lower side and fixed thereto by a fixing ring 10. Moreover, the first adjusting screw 8 is provided with cuts to serve as the aforesaid conduit orifices 6, and each of these conduit orifices 6 is provided with a narrowed passage 6a** in a part of the secondary valve so that gas of a quantity sufficient enough to ignite a main burner can be supplied therethrough.

Numeral 11 denotes a valve seat which is provided on the peripheral surface of the top portion of the secondary valve 5 for seating the primary valve 4 thereon. Numeral 12 denotes a spring for setting the primary valve 4 elastically on the valve seat 11 and numeral 13 denotes a spring for setting the secondary valve 4 elastically on a valve seat 9. Numeral 14 denotes a water supply channel, numeral 14a a bypass channel therefor, and numeral 15 a water-pressure-operated member. The water-pressure-operated member 15 comprises a diaphragm 15a operating in accordance with the pressure of supplied water and a tapered valve 15b moving together with said diaphragm 15a and facing the bypass channel 14a. One end of the valve rod is made to abut against said tapered valve so that it accompanies the diaphragm 15a in its movement.

Figure 2:
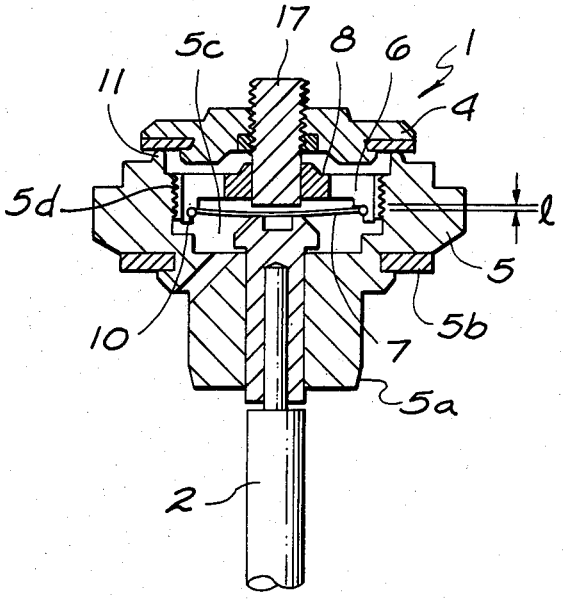
FIG. 2 is an enlarged view of the principal part thereof.
Figure 3:
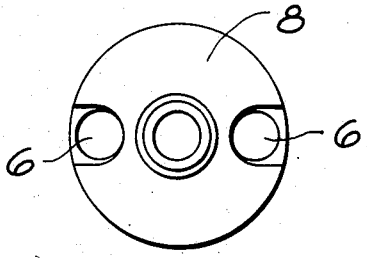
FIG. 3 is a plan view of a first adjusting screw.

Numeral 16 denotes a casing provided with the water supply channel 14 and a gas passage 3, and numeral 17 denotes a second adjusting screw threaded in the primary valve 4. The present system is assembled in such a manner that after the water-pressure-operated member 15, the valve rod 2 and the secondary valve 5 are set up at prescribed positions in the casing 16 while the correlative positions thereof are checked, the valve rod 1 is held in a state in which no water is supplied, in other words, in a state that it is moved to the lowermost position shown in FIG. 2. The first adjusting screw 8, to which the snap spring 7 is fitted in a state that it is curved downward, is screwed into the threaded hole 5d provided on the top side of the secondary valve 5, as far as the lower surface of said snap spring 7 comes into contact with the upper end of the valve rod 2.

Next, the valve rod 2 is put in a state in which water is supplied, in other words, in a state that the rod is put in an up-motion position. This means that the center of the constant force spring 7 pushed by the valve rod is moved to the uppermost position (however, without the constant force spring 7 being turned reversely). In this state, the primary valve 4 is set in pressure contact with the top surface of the secondary valve 5 by means of the spring 12. Next, the second adjusting screw 17 threaded in the primary valve 4 is threaded further so that the foreend thereof comes into contact with the constant force spring 7, and then, the supply of water being stopped, the screw 17 is advanced further until the constant force spring 7 escapes from the constant force region. In this way, the correlative positions of the valve rod 2 and the constant force spring 7 and of the constant force spring 7 and the second adjusting screw 17, can be secured esasily irrespective of the integration error or assembly error of components, and thus the aforesaid elements can be assembled correctly and simply.

In operation, when water is supplied through the water supply channel 14 by opening a stop cock, the diaphragm 15a is moved in accordance with the pressure of the supplied water, and the tapered valve 15b is opened in accordance with said motion, while the valve rod 2 is pushed up by the diaphragm 15a. Thereby the constant force spring 7 is pushed, and when getting in the constant force region, it holds up sharply the primary valve 4 to open the conduit orifices 6.

In more detail, the snap spring 7 is held at first in the state that it is curved downward to a large extent, and the valve rod 2 faces the lower surface of the spring, while the lower end of the second adjusting screw 17 provided in the primary valve 4 faces the constant force region of the spring 7 being curved sharply upward after it passes the constant force region, the primary valve 4 is opened instantaneously, and thereby the conduit orifices 6 are opened.

At the start of ignition, accordingly, the minimum quantity of gas sufficient enough to ignite a main burner is supplied to this burner through the conduit orifices 6 provided in the secondary valve 5, and thereby the main burner is ignited.

Then, when the valve rod 2 is moved upward with a successive increase in the quantity of water, the secondary valve 5 is pushed by said rod 2 and opened thereby as well.

Figure 4:
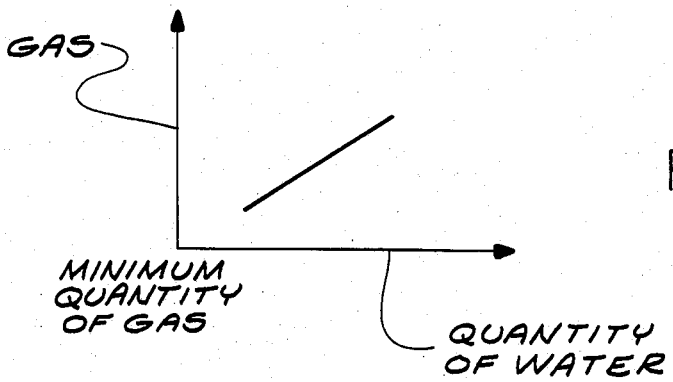
FIG. 4 is a diagram showing characteristics of operation of the device.

Since the secondary valve 5 opens in accordance with the amount of movement of the valve rod 2, the quantity of gas is proportional to the quantity of supplied water. FIG. 4 shows this relationship.

Next, when the stop cock is closed, the difference in pressure between a primary chamber and a secondary chamber, which are partitioned by the aforesaid diaphragm 15a, decreases, and the diaphragm 15a is moved in accordance with this decrease. Then the valve rod 2 is lowered with the movement of the diaphragm, and the primary valve 4 and the secondary valve 5 are pushed by the springs 12 and 13, respectively, to be lowered. Then, first the valve setting sheet 5b of the secondary valve 5 comes into pressure contact with the valve seat 9, and thereafter the constant force spring 7 is pushed by the lower end of the second adjusting screw 17, so as to escape from the constant force region. The spring force of the constant force spring 7 then increases sharply, the primary valve 4 is pushed strongly by said spring force, the conduit orifices 6 are thereby closed instantaneously, and thus the gas passage 3 is put in the state of full closure.

According to the present invention, as described above, the secondary valve provided with the conduit orifices 6 for conducting the minimum quantity of gas is constructed as a proportional, i.e., modulation, valve whose opening is varied in accordance with the amount of movement of the valve rod, while the first adjusting screw is threaded in the top portion of said secondary valve so that it supports the constant force spring, and the upper end of said valve rod piercing through said secondary valve is made to face the lower surface of said constant force spring, while the lower end of the second adjusting screw threaded in the primary valve is made to face the constant force region of the constant force spring on the upper surface thereof. Therefore, the relationships among the water-controlled element, the valve rod and the secondary valve, between the valve rod and the constant force spring and between the constant force spring and the primary valve can be maintained correctly in assembling these components only by operating the two adjusting screws sequentially and this produces effects that a system having high precision in assembly can be obtained easily, and that the assembly thereof can also be performed simply.

I claim:

1. In a water-pressure-operated automatic gas valve of an instantaneous gas water heater which is provided with primary and secondary valves opening and closing a gas passage to a main burner sequentially through the intermediary of a valve rod moving in accordance with the water flow rate passed through the heater, the primary valve being provided so that conduit orifices provided on the top side of the secondary valve for conducting the minimum quantity of gas are opened and closed in a snapping manner by the movement of a valve rod through the intermediary of a disk-shaped constant force spring, the improvement characterized in that said secondary valve is constructed as a modulation valve whose opening is varied in accordance with the amount of movement of said valve rod, and comprising:

a first adjusting screw threaded in the top portion of said secondary valve so that it supports said constant force spring whereby the lower surface of said constant force spring is faced with the upper end of said valve rod piercing through said secondary valve, and an adjusting screw threaded in the primary valve whereby the lower end thereof faces the constant force region of said constant force spring on the top surface thereof.

* * * * *